US008359812B2

(12) United States Patent
Raheel et al.

(10) Patent No.: US 8,359,812 B2
(45) Date of Patent: Jan. 29, 2013

(54) SINGLE STRIP SINGLE WEB GRID TEE

(75) Inventors: Muhammad M. Raheel, Mundelein, IL (US); James J. Lehane, Jr., McHenry, IL (US); Paul LaLonde, Highland Park, IL (US)

(73) Assignee: USG Interiors, LLC, Chicago, IL (US)

( * ) Notice: Subject to any disclaimer, the term of this patent is extended or adjusted under 35 U.S.C. 154(b) by 1067 days.

(21) Appl. No.: 11/617,776

(22) Filed: Dec. 29, 2006

(65) Prior Publication Data

US 2008/0155935 A1 Jul. 3, 2008

(51) Int. Cl.
*E04C 3/04* (2006.01)
*B21D 47/00* (2006.01)

(52) U.S. Cl. ..... 52/842; 29/897.35

(58) Field of Classification Search ..... 52/733.1, 52/730.6, 731.7, 506.07, 506.06, 837, 842, 52/846; 428/598, 603; 29/897.35
See application file for complete search history.

(56) References Cited

U.S. PATENT DOCUMENTS

| | | | | | |
|---|---|---|---|---|---|
| 693,560 | A | * | 2/1902 | Molloy | 52/842 |
| 991,603 | A | | 5/1911 | Brooks | |
| 1,457,303 | A | * | 6/1923 | Higgins | 52/842 |
| 1,927,442 | A | | 9/1933 | Laufle | |
| 2,065,378 | A | * | 12/1936 | Kling | 52/729.5 |
| 3,214,875 | A | | 11/1965 | Slowinski et al. | |
| 3,511,012 | A | * | 5/1970 | Brady | 52/667 |
| 3,526,073 | A | | 9/1970 | Brady | |
| 3,675,957 | A | * | 7/1972 | Lickliter et al. | 403/252 |
| 4,206,578 | A | * | 6/1980 | Mieyal | 52/733.1 |
| 4,520,609 | A | * | 6/1985 | Worley et al. | 52/733.1 |
| 4,554,718 | A | | 11/1985 | Ollinger et al. | |
| 5,163,225 | A | * | 11/1992 | Goleby | 29/897.35 |
| 5,535,569 | A | | 7/1996 | Seccombe et al. | |
| 6,047,511 | A | | 4/2000 | Lehane et al. | |
| 6,131,362 | A | * | 10/2000 | Buecker | 52/729.5 |
| 6,436,552 | B1 | * | 8/2002 | Walker et al. | 428/598 |
| 6,446,407 | B1 | | 9/2002 | Lehane et al. | |
| 6,523,314 | B1 | | 2/2003 | LaLonde et al. | |
| 6,964,140 | B2 | | 11/2005 | Walker et al. | |
| 2003/0154686 | A1 | * | 8/2003 | Platt | 52/733.1 |

FOREIGN PATENT DOCUMENTS

EP 267843 A1 * 5/1988

OTHER PUBLICATIONS

Notification of Transmittal of the International Search Report and the Written Opinion of the International Searching Authority, or the Declaration; International Search Report dated Sep. 23, 2008; Written Opinion of the International Searching Authority dated Sep. 23, 2008.

* cited by examiner

*Primary Examiner* — Christine T Cajilig
(74) *Attorney, Agent, or Firm* — Pearne & Gordon LLP

(57) ABSTRACT

A grid tee and method of making the same comprising an elongated sheet metal strip folded on itself to integrally form a lower double wall flange, a hollow upper reinforcing bulb, and a web extending upwardly between the flange and bulb, the flange generally lying in a horizontal plane, having opposed spaced parallel edges extending longitudinally, and being perpendicular to the web, the web lying in a generally vertical plane, the strip having two longitudinal extending marginal edge zones, said marginal edge zones being generally vertically disposed and fixed at least at longitudinally spaced locations to a central area of the strip that forms a portion of the web and forming a double web layer area, the marginal edge zones of the strip being vertically spaced from one another such that a portion of the central area of the strip that forms a part of the web is a single exclusive layer.

5 Claims, 1 Drawing Sheet

FIG. 1
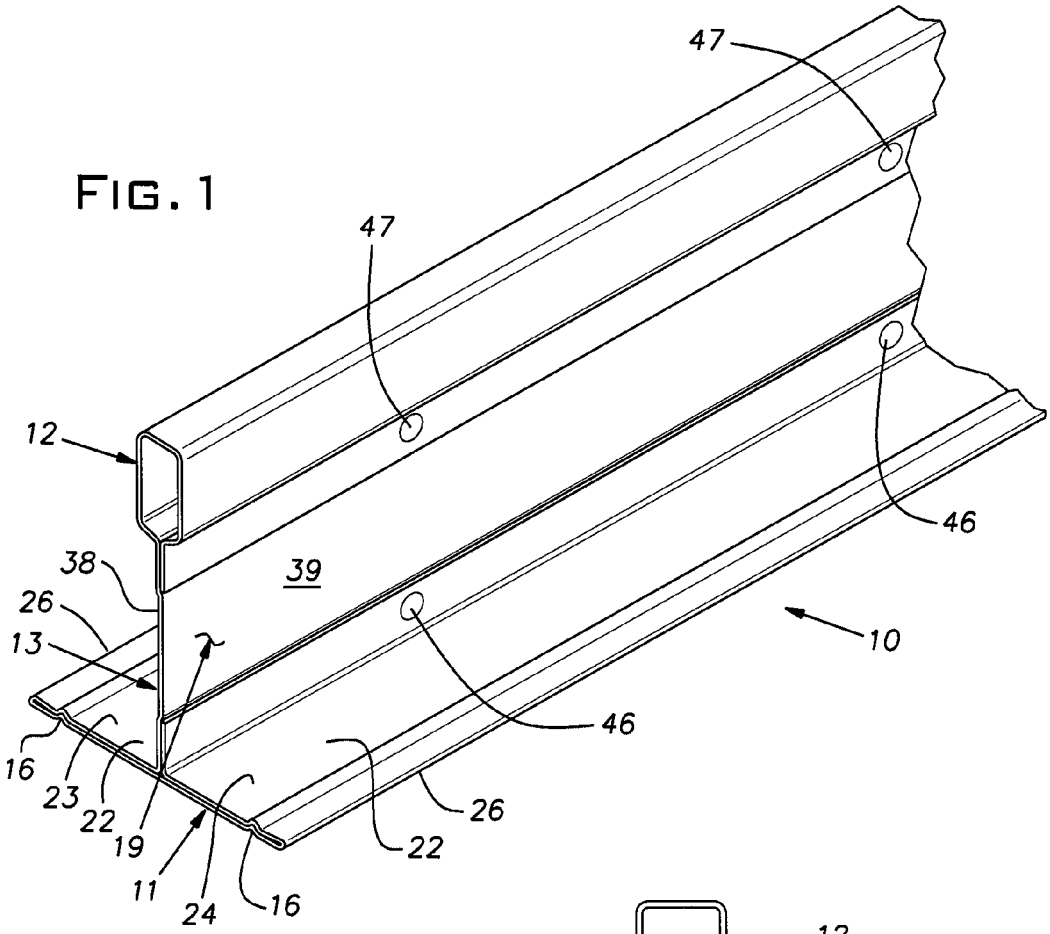
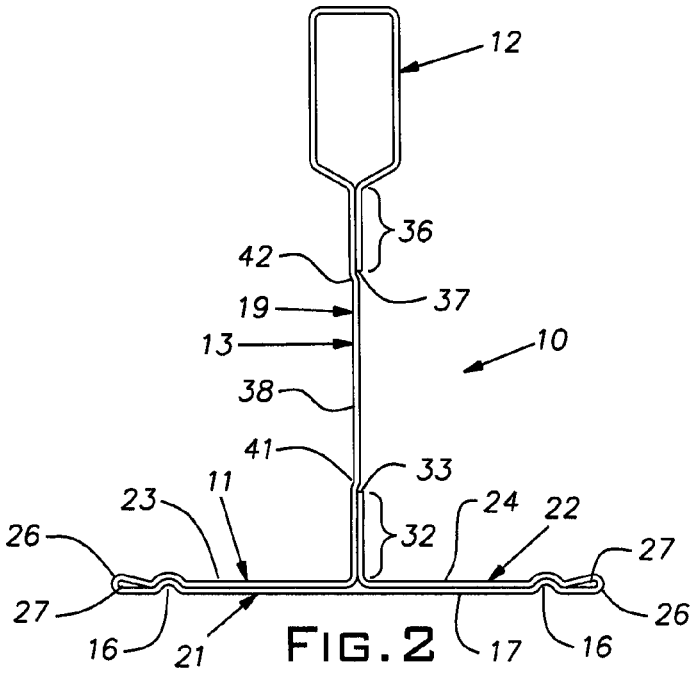
FIG. 2

SINGLE STRIP SINGLE WEB GRID TEE

BACKGROUND OF THE INVENTION

The invention relates to suspended ceiling grid and, in particular, pertains to an improved grid tee construction and method.

PRIOR ART

Suspended ceilings, typically, use grid elements or runners that have an inverted "T" cross-section. Most frequently, the grid tees are made from sheet metal rolled into their desired configuration. A lower flange of the inverted tee usually carries sheet material that extends horizontally across the spaces between adjacent grid tees and forms, at least, the major area of the visible ceiling surface. A hollow bulb at the top of the inverted tee section is normally provided to mechanically stiffen the grid tee. Variations in the basic cross-section of a roll-formed sheet metal grid tee have been proposed over the years to improve the performance in terms of load capacity, stiffness, and/or to reduce the manufacturing cost of the grid tees. It is known, for example, to make the web area, that is the part of the grid tee section between the lower flange and upper bulb in one or in multiple layers. Where the web is comprised of two layers it is known to fix these layers together at spaced locations. U.S. Pat. Nos. 5,979,055 and 6,047,511 disclose examples of the latter type of construction.

There remains a need to reduce the manufacturing cost of grid tee and make it easier to install, particularly where such advantages can be accomplished by a reduction in material content.

SUMMARY OF THE INVENTION

The invention provides a grid tee for suspended ceilings formed of a single metal strip sheet stock that incorporates a unique arrangement of folded and interlocked layers that achieves a high load capacity and, at the same time, can be formed of thinner stock to thereby reduce material content. It has been found, surprisingly, that despite an inherent lateral asymmetry in the web area, high beam strength and torsional strength can be achieved where the strip is folded and fastened to form two closed boundaries, one at the top encompassing the bulb, and one at the bottom encompassing the flange while an intermediate portion of the web between the flange and bulb is left as a single layer. The single layer web saves material but does not result in a proportional loss of beam strength. Besides saving material in the single layer mid-section of the web, the invention permits the use of lighter gauge stock in the entire cross-section thereby achieving an even greater savings of material content. Additionally, the lighter gauge material is easier to field cut so that it is easier to install.

The benefits of the invention can be obtained where the longitudinal marginal zones of the folded strip forming the tee cross-section are continuously joined or are joined at local points appropriately spaced along the longitudinal direction of the tee to the uninterrupted layer of the web.

BRIEF DESCRIPTION OF THE DRAWINGS

FIG. 1 is a fragmentary perspective view of a grid tee constructed in accordance with the invention, and FIG. 2 is an end view of the grid tee of FIG. 1 on an enlarged scale to show constructional detail.

DESCRIPTION OF THE PREFERRED EMBODIMENT

FIGS. 1 and 2 show one example of a grid tee 10 constructed in accordance with the invention. The illustrated grid tee 10 has an overall generally conventional cross-sectional profile of an inverted "T" that provides a lower horizontal flange 11, an upper hollow reinforcing bulb 12, and a generally vertical web 13 extending between the flange and the bulb. The tee 10 is preferably roll-formed with generally conventional tooling, known in the art. The tee 10 is made from a single strip of metal, typically steel or aluminum, soft or malleable enough to be formed into the illustrated or other desired shape.

The illustrated grid tee 10 can be used in drywall suspended ceilings and is formed with longitudinally extending grooves 16 in a lower face or side 17 of the flange 11. Such grooves 16, in addition to affording an increase in stiffness, are useful in limiting the tendency of self-drilling and tapping screws being driven upwardly into the flange 11 to secure a sheet of drywall to this face, from "skating" off the flange when an installer applies a high force to the screw before it has penetrated the flange and thereby causes the flange to tip up.

Describing the grid tee 10 in greater detail and in particular its cross-sectional shape or profile, a metal strip 19, from which the tee is formed, is folded on itself. The folds are such that the flange 11 comprises double layers 21 and 22. One layer 21 forms the lower face 17 while the other layer 22 comprises two separate parts 23, 24 each extending laterally on opposite sides of the web 13. At outer or distal edges 26 of the flange 11, the sheet or strip 19 is folded back on itself with a moderate inside bend radius that leaves a deliberate open space 27 on the inside of the respective fold of these edges. This open fold area 27 produces a flange structure that is stiffer and less wavy than what can occur where the sheet or strip 19 is folded essentially flat at the edges 26 and no open area exists. Both lateral parts 23, 24 of the upper flange layer 22 follow the contour of the lower or outer layer 21 where the grooves 16 exist.

The strip or sheet 19 is folded at both upper flange parts 23, 24 through 90 degrees where they merge with the web 13. In the view of the figures, the material of the strip 19 projecting from the leftward part 23 of the upper flange layer 22 is continuous or uninterrupted from the flange 11 to the bulb 12. By contrast, the material of the strip 19 projecting from the right part 24 of the upper flange layer 22 is a marginal zone 32 of the strip and terminates at a strip or sheet edge 33, preferably at an elevation spaced below the mid-height of the web 13.

The hollow bulb 12, in the illustrated example having a generally rectangular cross-section, is formed by a continuous wrap of the strip 19. Again, at the right side of the web 13, with reference to the FIGS., a marginal zone 36 of the strip depends from a lower side of the bulb 12 and terminates at an edge 37.

As mentioned, the web 13 includes a layer 38 that is continuous between the flange 11 and bulb 12, formed by an intermediate section of the full width of the strip 19. The layer 38 forms the sole or exclusive layer 39 of the web 13 in the vertical space between the lateral edges 33, 37 of the strip 19. The continuous web layer 38 is formed with a pair of vertically spaced offsets or bends 41, 42. The offsets 41, 42 position most of the single layer 39 of the web 39 in a nominal mid-plane of the tee 10, i.e. a centered imaginary vertical plane that laterally bisects the flange 11 and bulb 12. This geometry afforded by the bends or offsets 41, 42 minimizes the lateral eccentricity that exists in the cross-section of the tee 10 owing to the gap between the edges 33, 37 of the marginal zones 32, 36.

Both marginal zones 32, 36 of the strip or sheet 19, that is, the elements forming partial web double layers, are fixed to the continuous web layer 38 which they abut. These partial web layers or marginal zones 32, 36 can be fixed in any suitable known manner including without limitation welding, fusing, bonding, soldering, mechanical fastening, and/or adhesive fastening. The marginal zones 32, 36, can be fixed to the continuous layer 38 continuously along the length of the tee 10 or can be fixed at spaced locations along the length as is the case shown in FIG. 1. Regularly spaced locations indicated at 46, 47 where the web layers 38, 32 and 36 are fixed together by spot welding are shown in FIG. 1. The longitudinal location of these points 46, 47 need not be the same at each of the marginal zones 32, 36. It has been discovered that a maximum spacing of the locations of welds or other local fixing expedients exists for a tee 10 of a given cross-sectional geometry and the physical characteristics of the material of the strip or sheet 19 beyond which a significantly weakened product results. The maximum longitudinal spacing of the points 46, 47 will depend, inter alia, on the geometry of the tee 10, strength of the material of the strip or sheet 19, and gauge or thickness of the strip. By way of example, where the tee 10 has a height of 1½", and is made of hot dipped galvanized (HDG) mild steel, and is nominally 0.012" thick, a spacing of about 2 times the height of the tee can achieve good results, but distances greater than 4 times the height of the tee typically result in unacceptably low load capacity where the grid is to be used for constructing a suspended drywall ceiling.

It will be seen that fixing the marginal zones 32 and 36 to the continuous layer 38 at spaced points 46, 47, or continuously structurally produces two closed boundaries or closed sections. One of the closed boundaries is provided by the bulb and adjacent areas of the continuous layer 38 and zone 36. The other of the boundaries is formed by the flange 11 and adjacent areas of the web provided by the layer 38 and zone 32. It will be seen that the hollow areas 27 at the edges 26 of the flange 11 can add a proportionate torsional stiffness to the tee when they exist as part of this closed boundary. These two closed boundaries greatly stiffen the tee particularly in torsion.

The disclosed grid tee construction can be used for main runners and cross runners. The grid tee 10 can be provided with suitable end connectors whether integral or by way of separate clips as is known in the industry. The web 13 can be slotted to receive the connectors of cross tees. The invention can be applied to grid tees intended for use with lay-in tiles and the like. In suspended drywall ceiling applications, the disclosed grid tee 10 has the potential to save as much as 28% of the material of a conventional commercial prior art product. Besides saving material, the thinner gauge stock, made possible by the invention, is more readily cut manually with a pair of snips thereby making the disclosed grid tee easier to install.

It should be evident that this disclosure is by way of example and that various changes may be made by adding, modifying or eliminating details without departing from the fair scope of the teaching contained in this disclosure. For example, it is contemplated that the marginal zones of the strip can be arranged on opposite sides of the continuous layer of the web. The invention is therefore not limited to particular details of this disclosure except to the extent that the following claims are necessarily so limited.

What is claimed is:

1. A grid tee comprising an elongated sheet metal strip folded on itself to integrally form a lower double wall flange, a hollow upper reinforcing bulb, and a web extending upwardly between the flange and bulb, the flange generally lying in a horizontal plane and having its walls contiguous across substantially its full width so as to avoid relatively large hollows in an area below the web and symmetrically disposed relative to said web, the flange being substantially wider than the bulb, having opposed spaced parallel edges extending longitudinally, and being perpendicular to the web, the web lying in a generally vertical plane, the hollow bulb being symmetrically disposed about the plane of the web, the strip having two longitudinal extending marginal edge zones, said marginal edge zones being generally vertically disposed and fixed at least at longitudinally spaced locations to a central area of the strip that forms a portion of the web and forming a double web layer area, the marginal edge zones of the strip being vertically spaced from one another such that a portion of the central area of the strip that forms a part of the web is a single exclusive layer.

2. A grid tee as set forth in claim 1, wherein said marginal edge zones are spot welded at longitudinally spaced intervals along the web.

3. A grid tee as set forth in claim 1, wherein said marginal edge zones are fixed by one or more expedients including spot welds, mechanical fasteners and adhesives.

4. A grid tee as set forth in claim 1, wherein the mid-section of the strip forming the central exclusive layer part of the web is offset in a lateral direction from adjoining portions of the sheet such that it is centered in a plane that laterally bisects said bulb and said flange.

5. A method of constructing a grid tee comprising the steps of providing a metal strip, folding the strip on itself such as by conventional roll forming techniques, the strip being folded in a manner so as to integrally form a double layer flange, a hollow reinforcing bulb spaced from the flange, and a web joining the flange and bulb, with the bulb being symmetrically disposed over the web, the layers of the flange being contiguous so as to avoid relatively large hollows in an area below the web and symmetrically disposed on both sides of the web, the strip being folded such that its marginal edges lie in the area of the web spaced vertically from one another and a central area of the strip forms a single exclusive layer part of the web in a vertical zone between said marginal edges, the marginal zones of the strip associated with said marginal edges being fixed to abutting mid areas of the strip adjoining the area forming said single layer part.

* * * * *